United States Patent [19]

Martin

[11] Patent Number: 4,927,031

[45] Date of Patent: May 22, 1990

[54] DOCUMENT SORTER FOR READER/PRINTER EQUIPMENT

[75] Inventor: Emilio B. Martin, Madrid, Spain

[73] Assignee: AMPER, S.A., Madrid, Spain

[21] Appl. No.: 350,097

[22] Filed: May 10, 1989

[30] Foreign Application Priority Data

May 10, 1988 [ES] Spain ..... 8801449

[51] Int. Cl.[5] ..... B07C 5/36; B65H 29/70

[52] U.S. Cl. ..... 209/657; 271/188; 271/224; 271/305

[58] Field of Search ..... 209/563–566, 209/569, 583, 584, 656, 657, 900; 271/17–18, 185, 187, 188, 209, 223, 224, 303, 305

[56] References Cited

U.S. PATENT DOCUMENTS

| | | | |
|---|---|---|---|
| 3,087,724 | 4/1963 | Snowdon et al. | 271/188 |
| 3,420,518 | 1/1969 | Eveland et al. | 271/223 X |
| 4,019,640 | 4/1977 | Marin et al. | 271/209 X |
| 4,251,000 | 2/1981 | Templeton | 271/188 X |
| 4,275,875 | 6/1981 | Akers | 271/305 X |
| 4,486,015 | 12/1984 | Takahashi | 271/305 |

*Primary Examiner*—Johnny D. Cherry
*Assistant Examiner*—Edward M. Wacyra
*Attorney, Agent, or Firm*—Johnson & Gibbs

[57] ABSTRACT

A device for sorting documents exiting a document processor such as a document reader or document printer includes at least one document guide which defines an undeflected document travel path and a document bin which includes a series of compartments for receiving sorted documents. Each document guide will alternately permit the documents to travel along the undeflected document travel path to a first document bin or to deflect such documents in first or second deflected document travel paths to compartments of second document bins. By selectively deflecting documents entering the document guide, previously processed documents may be sorted according to document type. Each document guide is comprised of first and second concave guide parts mounted side by side to define an undeflected document travel path therebetween and first and second convex guide parts mounted outside the concave guide parts. The concave guide parts each have a concavely curved outer side. Each convex guide part is positioned such that a convexly curved inner side of the convex guide part faces the concavely curved outer side of each concave guide part. When the document guide is in a first position, documents entering the document guide continue to travel along the undeflected document travel path. The respective rotation of the first and second concave guide parts position the document guide into second and third positions which deflect the documents entering the guide.

18 Claims, 3 Drawing Sheets

DOCUMENT SORTER FOR READER/PRINTER EQUIPMENT

FIELD OF THE INVENTION

This invention relates to a document sorter for sorting documents previously processed by a processing device such as a document reader and/or printer. More specifically, this invention relates to a document sorter which sorts different types of documents by selectively diverting the documents to a series of bins according to document type.

BACKGROUND OF THE INVENTION

Document processing systems which include document processing devices such as document readers for reading characters printed on documents and/or document printers for printing characters on the documents are well known. For example, bank checks and similar types of documents may be processed by a document processing system which includes a document feeder which supplies the documents to read and/or print stations for reading coded characters from the documents and/or printing such coded characters onto the documents. Most typically, the documents would travel along a document guide past the read and/or print stations. After processing by the read and/or print stations, the documents are transported along the guide to an output area where the documents must exit already sorted.

Document sorters which would satisfactorily sort documents prior to exiting the processing system generally suffer from the problems of large size and high manufacturing cost. These problems are of particular concern for sorters intended to be used with document processing systems such as the ones described above.

The document sorter proposed by the invention has been designed to fully resolve the problems described above, offering for that purpose a structure that is simple, effective and economical for utilization with document processing apparatus such as reading and/or printing devices which process documents such as those issued by banking entities.

SUMMARY OF THE INVENTION

A device for sorting documents exiting a document processor such as a document reader or document printer includes at least one document guide which defines an undeflected document travel path and a document bin which includes a series of compartments for receiving sorted documents. Each document guide will alternately permit the documents to travel along the undeflected document travel path to a first document bin or to deflect such documents in first or second deflected document travel paths to compartments of a second document bins. By selectively deflecting documents entering the document guide, previously processed documents may be sorted according to document type. While any number of different types of documents may be sorted in accordance with the teaching of the present invention, the device described herein is capable of sorting up to seven types of documents, or by connecting two such sorters to form a continuous document travel path, up to thirteen types of documents.

Each document guide is comprised of first and second concave guide parts mounted side by side to define an undeflected document travel path therebetween and first and second convex guide parts mounted outside the concave guide parts. The concave guide parts, which preferably are of a substantially triangular configuration, each have a concavely curved outer side. Each convex guide part is positioned such that a convexly curved inner side of the convex guide part faces the concavely curved outer side of the corresponding concave guide part. Pulling means such as a drive wheel in tangential contact with a rotatably mounted guide wheel are positioned at the entry of each document guide to pull unsorted documents through the document guide. The document is pulled between the wheels and enters the document guide. When the document guide is in a first position, documents entering the document guide continue to travel along the undeflected document travel path until exiting into the end collection bin. However, when the document guide is in a second or third position, documents entering the document guide are deflected onto first or second deflected document travel paths, respectively, to compartments of the side document bins.

Each concave guide part is mounted on a rotatable shaft driven by an electromagnet. When the electromagnets are not activated, documents entering the document guide will continue along the document travel path. When the electromagnet which drives a first concave guide part is activated, for example, by a programmed command, the first concave guide part is rotated to reposition the document guide into a second position which diverts the document by allowing it to slide between the concavely curved side of the first concave guide part and the convexly curved of the corresponding convex guide part, i.e., the first deflected travel path, instead of the undeflected document travel path. Similarly, a second concave guide part may be rotated to reposition the document guide into a third position which diverts the document by allowing it to slide between the concavely curved side of the second concave guide part and the convexly curved side of the corresponding convex guide part, i.e. the second deflected travel path, instead of the undeflected document travel path. As a result, documents entering the sorter may be selectively deflected to one or the other side of any of a series of document guides to access a series of sorting bins or to continue undeflected through each of the document guides to exit into an end bin.

In another embodiment of the invention, the shaft on which the guide wheel corresponding to the first document guide is pivotable such that the shaft may be tilted away from the tangentially contacting drive wheel. A spring is also provided to force the guide wheel into tangential contact with the drive wheel. An electromagnet capable of acting on the pivotable shaft to separate the pull and guide wheels is provided, thereby preventing a document from being pulled while part of the document is still in the reading station. A series of photo detectors are also provided to detect the documents entering the sorter as well as sorted documents travelling towards the bin compartments.

BRIEF DESCRIPTION OF THE DRAWINGS

The invention may be better understood and its numerous objects and advantages will become apparent to those skilled in the art by reference to the following drawings in which.

DETAILED DESCRIPTION OF THE INVENTION

Figure 2:
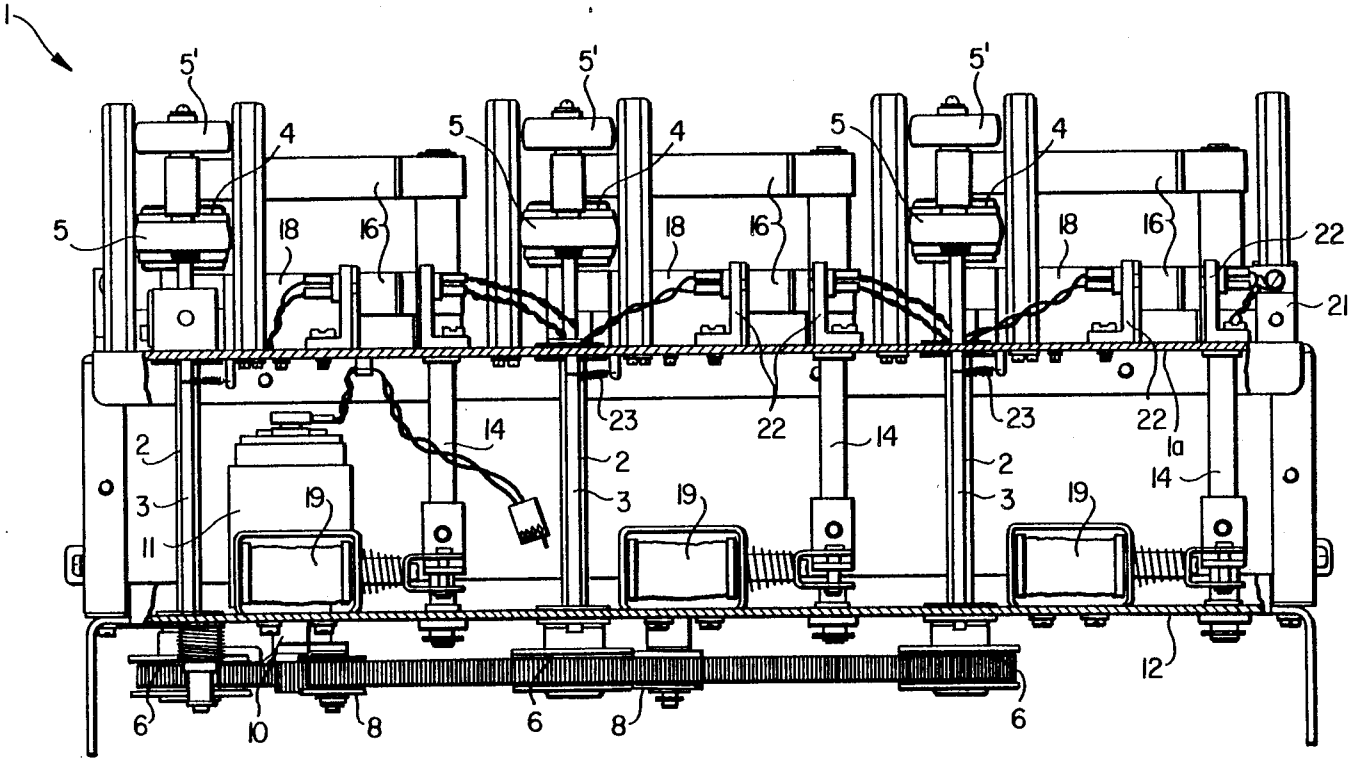
FIG. 2 is a cross-sectional view along line 2—2 of FIG. 1.

Turning first to FIG. 2, a document sorter constructed in accordance with the teaching of the present invention is now described in detail. The document sorter of the present invention may be included in a document processing system. For example, the document sorter may be mounted at the exit of a document reader and/or document printer. In such a configuration, processed documents may be sorted based upon the data read from or printed onto the documents.

Document sorter 1, which is mounted to the exit of a document reader and/or printer (not shown) such that documents will enter document sorter 1 after being processed by the document reader and/or printer, has a general support structure which includes an upper support plate 1*a* and a lower support plate 12 generally parallel to and spaced a distance from upper support plate 1*a*. A series of shaft pairs comprised of a first rotatable shaft 2 and a second rotatable shaft 3 extend upward, passing through corresponding openings (not shown) in plate 1. Each shaft 2 is spaced an equal distance from the corresponding shaft 3. Wheels 4 and 4' are mounted on each shaft 2 such that each wheel 4 is mounted on a first level and each wheel 4' is mounted on a second level above the first level. Similarly, wheels 5 and 5' are mounted on each shaft 3, again such that each wheel 5 is mounted on the first level and each wheel 5' is mounted on the second level above the first level. For each shaft pair 2, 3, wheel 4 faces corresponding wheel 5 and wheel 4' faces corresponding wheel 5' (see FIG. 1).

Each shaft 3 is held in position by a biasing spring 23 mounted between each shaft 3 and the support structure of document sorter 1. Shaft 3 may be pivoted against the biasing force of spring 23 to increase the separation between wheels 4 and 5 and the separation between wheels 4' and 5', respectively. In such a manner, the passage of documents of different thickness between the wheels is permitted. Photo detector 21 is positioned at the entry of document sorter 1. Additional photo detectors 22 are positioned at the exit of each deflection path.

Figure 3:
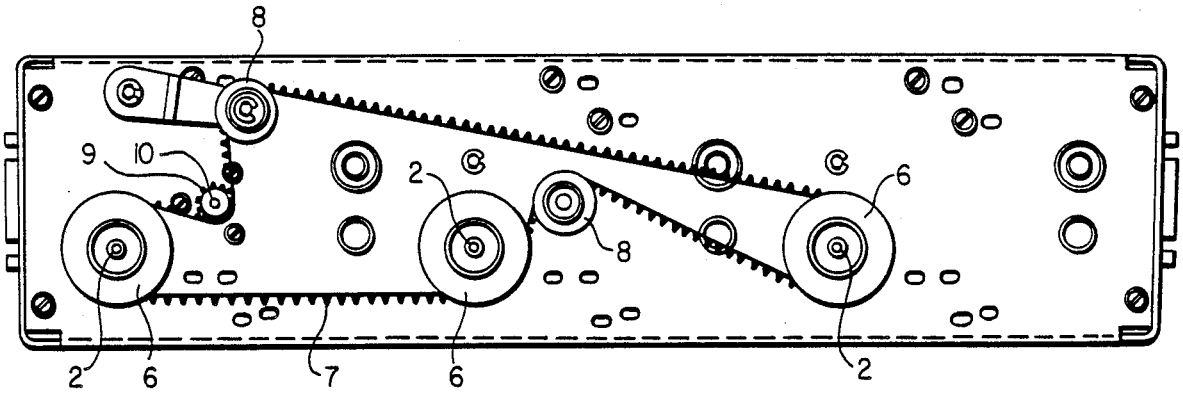
FIG. 3 is a bottom view of the document sorter of FIGS. 1 and 2.

Turning now to FIG. 3, the drive system for document sorter 1 will now be described in greater detail. The drive system for document sorter 1 is located beneath lower plate 12. Pulley 6 is mounted onto the lower end of each shaft 2. A toothed belt 7 is mounted around pulleys 6, tensor guide rollers 8 and pinion 9. When pinion 9 rotates, pinion 9 causes toothed belt 7 to move, thereby resulting in the rotation of pulleys 6. In turn, the rotation of pulleys 6 rotates each shaft 2, thereby rotating wheels 4 and 4'. As may be more clearly seen in FIG. 2, document sorter 1 includes a conventional drive means which includes motor 11 and output shaft 10. Motor 11 drives output shaft 10 into rotation and, as pinion 9 is mounted on output shaft 10, pinion 9 is rotated by the rotation of output shaft 10. Output shaft 10 will thus rotate, via pinion 9, the drive system formed by the pulleys 6, toothed belt 7, guide roller 8 and pinion 9.

Each wheel 4 described above may also be referred to as drive wheel 4 since each drive wheel 4 is driven by the rotation of a shaft 2 by pulleys 6. Wheels 4', on the other hand, may also be referred to as guide wheels despite being mounted on rotated shaft 2. The distinction is hereby set forth because wheels 4' act only as a guide for the documents and do not act to pull the documents through document sorter 1. Such a distinctions results since drive wheel 4 and guide wheel 5 are positioned in tangential contact with each other while guide wheels 4' and 5' are slightly separated from each other. As a result, only wheels 4 and 5 press against each other to pull documents positioned therebetween forward.

Again referring to FIG. 1, an electromagnet 24 is positioned at the entry 1*b* of document sorter 1. Electromagnet 24 acts on the first shaft 3 such that when electromagnet 24 is activated, shaft 3 is pivoted. As a result, guide wheel 5 and drive wheel 4 are separated, thereby preventing document sorter 1 from pulling a document forward while that document is being read by a corresponding reading/printing device.

Figure 1:
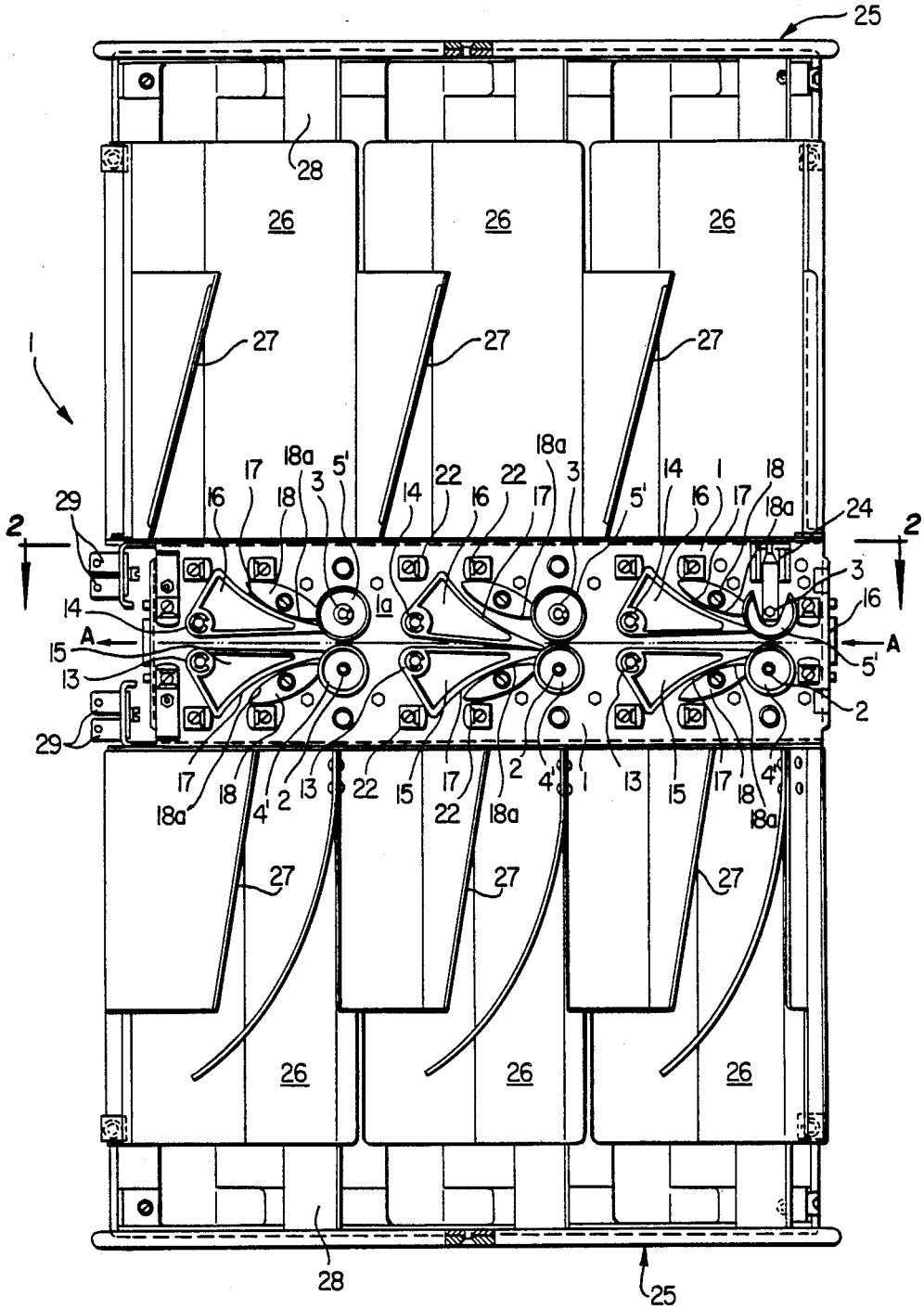
FIG. 1 is a top view of a document sorter for sorting seven types of documents constructed in accordance with the teachings of the present invention.

Turning now to FIGS. 1 and 2, a second series of rotatable shaft pairs of document sorter 1 are now described in detail. Each second rotatable shaft pair comprises a first rotatable shaft 13 (visible only in FIG. 1) and a second rotatable shaft 14 mounted on lower support plate 12. A series of document guides are each comprised of a first concave guide part 15 mounted on the corresponding shaft 13 and a second concave guide part 16 mounted on the corresponding shaft 14 such that the first concave guide part 15 and the second concave guide part 16 mounted on each pair of shaft 13, 14, face each other. Each concave guide part 15, 16, which may be of a generally triangular shape, comprising the series of document guides is mounted on shafts 13, 14 at the same first level at which wheels 4, 5 are mounted. Preferable, an additional first concave guide part 15 is to be mounted on each shaft 13 and an additional second concave guide part 16 mounted on each shaft 14 such that the additional first and second concave guide parts 15 and 16 corresponding to a shaft pair 13, 14 face each other as well. The additional first and second concave guide parts 15 and 16 are to be mounted at the same second level at which wheels 4' and 5' are mounted.

Focussing now on FIG. 1, the document guide which includes concave guide parts 15 and 16 shall now be described in greater detail. Each document guide part 15, 16, which preferably are of identical generally triangular construction, include an inner side and a concavely curved outer side 17. The inner sides of each pair of concave guide parts 15, 16 define a undeflected document travel path for documents entering the document guide. Facing each concave guide part 15, 16 mounted on the first (or lower) level is a convex guide part 18 rotatably mounted to support plate 1*a* by conventional means. Each convex guide part 18 includes a convexly curved inner side 18*a* which faces the complementary shaped concavely curved outer side 17 of the corresponding concave guide part 15, 16.

An electromagnet 19 is mounted on the lower end of each shaft 13, 14. Upon activation of electromagnet 19 and the resulting withdrawal of the core of the activated electromagnet, electromagnet 19 will rotate the shaft 13, 14 which is mounted to the activated electromagnet. The rotation of shaft 13 or 14 will pivot the corresponding concave guide part 15 or 16 mounted to the rotating shaft, thereby controlling the direction of travel of documents entering the document guide corresponding to the rotated guide part 15, 16.

Having fully described the structure of document sorter 1, the sorting of documents by the aforedescribed document sorter 1 is now set forth in detail.

Unsorted documents, which may be of several different types, enter document sorter 1 after processing by a document reader and/or document printer. The documents enter document sorter 1 at entry 1*b* and travel through document sorter 1 in the direction of arrow "A" illustrated in FIG. 1. Each document entering document sorter 1 will travel in direction "A" and, unless diverted in the manner set forth below, will pass through each wheel pair 4, 5 mounted on shafts 2, 3, respectively, at the lower level and wheel pair 4', 5' mounted on shafts 2, 3 respectively, at the higher level. As each wheel 4 is in tangential contact with the corresponding wheel 5, wheel pair 4, 5, tangentially contact the document travelling therebetween, pulling the document forward in direction "A". The document will thus travel undeflected along the document travel path defined by the inner sides of concave guide parts 15, 16 which form a document guide.

To sort the documents passing through document sorter 1, the documents are deflected from the document travel path into a series of sorting bins 26. To sort documents, a command is issued to activate a selected electromagnet 19 to rotate the shaft 13, 14 to which the selected electromagnet 19 is mounted to. By rotating the shaft 13, 14 corresponding to the selected electromagnet 19, the concave guide part 15, 16 mounted thereon will be pivoted. By pivoting concave guide part 15, the document guide is pivoted out of a first position where documents entering the guide would travel undeflected along the undeflected travel path defined by the inner sides of concave guide parts 15 and 16 and into a second position where documents entering the guide would be deflected along a first deflected travel path defined by the concavely curved side 17 of concave guide part 15 and the inner side of the convex guide part 18 facing concavely curved side 17 of concave guide part 15. Similarly, if concave guide part 16 was selected for pivoting, the document guide part is pivoted out of the first position and into a second position where documents entering the guide would be deflected along a second deflected travel path defined by the concavely curved side 17 of concave guide part 16 and the inner side of the convex guide part 18 facing concavely curved side 17 of concave guide part 16. For example, in FIG. 1, the concave guide part 16 of the middle document guide has been pivoted out of contact with convex guide part 18 and into contact with concave guide part 15. In such a manner, a document which would have travelled along the undeflected document travel path defined by the inner sides of guide parts 15 and 16 will now travel along a first deflected travel path defined by the space between the concavely curved said 17 of concave guide part 16 and the convexly curved side 18*a* of convex guide part 18, thus deflecting the document into the diverted travel path towards a sorting bin 26 to be more fully described later.

The sorting of documents entering document sorter 1 is thus controlled by control means (not shown) which issue commands for the document or documents to enter sorter 1 and to be selectively deflected to one or another of the sorting bins 26 by the activation of the electromagnet 19 which will pivot the appropriate concave guide part 15, 16 for providing the diverted document path to the desired sorting bin 26. The operation of document sorter 1 may be separated into three distinguishable states: "rest", "wait" and "entry" into the desired bin.

During the first or "rest" state, document sorter 1 is deactivated awaiting a sort order. When a sort order, i.e. an order to sort a document entering document sorter 1 into a specified sorting bin 26, is received, motor 11 goes into operation and a selected electromagnet 19 is activated to provide a deflection path for the document to travel to the desired sorting bin. At this point, document sorter 1 will reach the second or "wait" state.

In the "wait" state, the motor 11 of document sorter 1 is in operation, the desired document deflection path is provided and the photo detector 21 positioned at entry 1*b* is in the activated state awaiting the entry of the document into document sorter 1. Once entry of a document is detected by photo detector 21, photo detector 22 corresponding to sort bin 26 will activate. At this point, document sorter 1 will now reach the third or "bin entry" state. In the "bin entry" state, when a photo detector 22 detects the entry of the document being sorted into a sorting bin, the deflection path is deactivated, i.e., the deflection path is closed by pivoting the same guide part 15 or 16 by the appropriate electromagnet 19 such that guide part 15 or 16 is returned to its original position. At this point, document sorter 1 would again be in the "rest" state.

Figure 4:
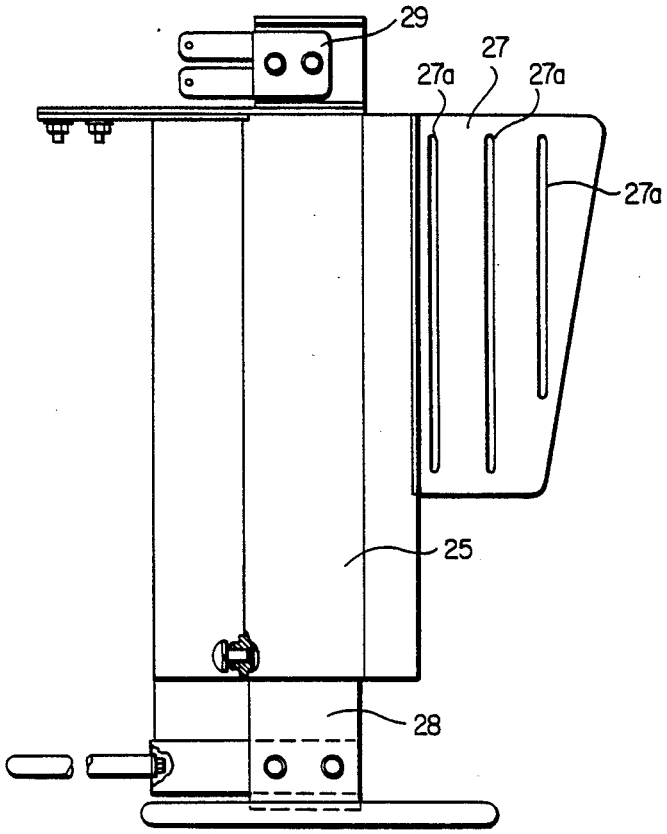
FIG. 4 is a side view of the sorting bin assembly provided on one side of the sorter of FIGS. 1–3.

As has already been discussed in great detail, documents entering document sorter 1 can be deflected along a first deflected path towards one side of the sorter or be deflected along a second deflected path towards the other side of the sorter. Turning now to FIG. 4, the sorting bin assembly 25 mounted on each side of document sorter 1 for the orderly reception of the different types of documents will now be described in detail. On each side of document sorter 1, each sorting bin assembly 25 has a series of compartments 26 equal to the number of document guides provided for by sorter 1. Each compartment 26 includes a tilted plate 27 with projections 27*a* so that the sorted documents properly access each compartment 26 and do not stick to the wall of the compartment.

Each bin assembly 25 is mounted on a side of document sorter 1 may be different for each side. Both bin assemblies 25 will be symmetrical, however, so that the deflected documents will access the selected compartments 26 in an orderly fashion on each side of the document sorter. Each bin assembly 25 is also provided with a movable part 28 which can increase the length of the different compartments 26 of bin assembly 25. To do so, movable part 28 should be moved in one direction or the other to change the length of compartments 26.

Finally, these bin assemblies 25, each provided on one side, are furnished with elastic tabs 29 which connect bin assemblies 25 to ground, thereby discharging any static electricity that could accumulate, and cause a spark discharge resulting in a disturbances which could cause transitory alterations in the operation of the equipment.

It is not considered necessary to make this description more extensive for any expert on the subject to be able to understand the scope of the invention and the advantages deriving therefrom. The materials, shape, size and arrangement of the components may be varied, as long as this does not involve an alteration of the essence of the invention. The terms used in the description of this report must always be taken in a broader and not in a limited sense.

Thus, there has been described and illustrated herein a document sorter for sorting documents previously processed by a processing device such as a document reader and/or printer. However, those skilled in the art will recognize that many modifications and variations besides those specifically mentioned may be made in the techniques described herein without departing substantially from the concept of the present invention. Accordingly, it should be clearly understood that the form of the invention described herein is exemplary only, and is not intended as a limitation on the scope of the invention.

What is claimed is:

1. A document sorter for sorting different types of documents processed by a document reader/printer according to type of document comprising:

a support structure;

at least one drive wheel pair for pulling said documents through said document sorter, each said drive wheel pair comprised of a drive wheel and a guide wheel in tangential contact with each other and mounted on said support structure;

at least one document guide, each said document guide comprised of first and second concave guide parts rotatably mounted on said support structure and first and second convex guide parts, said first and second concave guide parts each having an inner side and a concavely curved outer side, said inner sides facing each other to define a document passage therebetween through which undeflected documents travel, said first and second convex guide parts each having a convexly curved side respectively facing said first and second concavely curved outer sides, said first concavely curved outer side and said first convexly curved inner side defining a first deflected document path, said second concavely curved outer side and said second convexly curved inner side defining a second deflected document path;

a pair of compartmentalized sorter bins mounted on said support structure, each said compartment of said sorter bins receiving a different type of document; and means for selectively deflecting said documents along said first or said second deflected document path.

2. The document sorter according to claim 1 wherein said means for selectively deflecting said documents along said first or said second deflected document path further comprises:

a first shaft mounted to each of said first concave guide parts;

a first actuatable electromagnet mounted to each of said first shafts, the actuation of said electromagnet rotating said first shaft and said first concave guide part mounted thereon from a first position where documents entering said document guide travel along said undeflected document path to a second position where documents entering said document guide travel along said first deflected document path;

a second shaft mounted to each of said second concave guide parts; and a second actuatable electromagnet mounted to each of said second shafts, the actuation of said electromagnet rotating said second shaft and said second concave guide part mounted thereon such that said document guide pivots from said first position to a third position where documents entering said document guide travel along said second deflected document path.

3. The document sorter according to claim 2 wherein said first and second concave guide parts further comprise are generally triangularly shaped.

4. The document sorter according to claim 2 further comprising:

a motor; and at least one rotatable drive shaft driven by said motor, each said rotatable drive shaft corresponding to one of said at least one drive wheel, each said drive wheel rotated by said corresponding rotatable drive shaft.

5. The document sorter according to claim 4 further comprising:

an additional guide wheel mounted on each of said at least one rotatable drive shaft;

at least one rotatable guide shaft, each of said guide wheels mounted on a corresponding one of said at least one rotatable guide shafts; and an additional guide wheel mounted on each of said at least one rotatable guide shaft; wherein said additional guide wheels being mounted in pairs located above said drive wheel pair, said guide wheels of each said guide wheel pair being separated from each other.

6. The document sorter according to claim 5 further comprising a spring, each said guide shaft pivotable to allow separation of said guide wheel from said drive wheel, said spring biasing said guide shaft such that said guide wheel is biased into tangential contact with said drive wheel.

7. The document sorter according to claim 2 further comprising:

first photo detector means positioned at said entry to detect documents entering said document sorter; and second photo detector means positioned along each diverted document path for detecting sorted documents.

8. The document sorter according to claim 2 further comprising:

a guide shaft rotatably mounted by said support assembly, said guide wheel mounted on said guide shaft;

spring means mounted to said support assembly for biasing said guide shaft such that said guide wheel tangentially contacts said drive wheel; and an actuatable electromagnet for controlling said guide shaft, said electromagnet controlling the pivoting of said shaft against said spring means such that said guide wheel is separated from said drive wheel.

9. The document sorter according to claim 8 wherein each of said pair of compartmentalized sorter bins are mounted on opposite sides of said support structure, said compartmentalized sorter bins being mounted symmetrical with each other, each said compartmentalized sorter bin further comprising a series of compartments having a plate with projections thereon to facilitate the sliding of the documents into said compartments and the correct positioning of said documents within said compartments and a movable wall for modifying the length of documents which may be received by said compartments.

10. Apparatus for sorting documents comprising:

at least one document guide having an entry, said document guide comprised of first and second concave guide parts, each of said first and second concave guide parts having an inner side and a concavely curved outer side, said inner sides defining a document passage therebetween;

first and second convex guide parts, said first and second convex guide parts each having a convexly curved inner side, said outer concavely curved sides of said first and second concave guide parts facing said first and second convexly curved inner sides of said first and second convex guide parts, respectively;

means, positioned at said entry of each of said at least one guide, for pulling documents into said guide;

means for pivoting said first concave guide part such that documents entering said guide are deflected in a first direction; and means for pivoting said second concave guide part such that documents entering said guide are deflected in a second direction.

11. The document sorter according to claim 10 wherein said means for pulling documents into said guide further comprises a pull wheel for pulling said documents and a guide wheel for guiding said pulled documents, said pull wheel and said guide wheel in tangential contact with each other.

12. The document sorter according to claim 11 further comprising a pivotable guide shaft, said guide wheel mounted on said pivotable guide shaft, said guide shaft pivotable to separate said guide wheel from said pull wheel, thereby preventing entry of documents into said guide.

13. The document sorter according to claim 12 further comprising:

a drive shaft, said pull wheel mounted on said drive shaft;

a second guide wheel mounted on said guide shaft above said first guide wheel; and a third guide wheel mounted on said drive shaft above said pull wheel, said second and third guide wheels positioned the same height above said first guide wheel and said pull wheel, respectively, said second and third guide wheels slightly separated from each other.

14. The document sorter according to claim 13 further comprising:

first and second document guide shafts corresponding to each of said least one document guides, said first concave guide part mounted on said first document guide shaft and said second concave guide part mounted on said second document guide shaft; and a second document guide having an entry, said second document guide comprised of first and second concave guide parts, each of said first and second concave guide parts having an inner side and a concavely curved outer side, said inner sides defining a document passage therebetween.

15. The document sorter according to claim 14 further comprising:

electromagnetic control means for controlling said guide shafts; and spring means for biasing guide shaft such that said first guide wheel tangentially contacts said pull wheel;

wherein the activation of said electromagnetic control means controls the pivoting of said shaft against said spring means, thereby separating said first guide wheel from said pull wheel and preventing the document from being pulled into said document sorter.

16. The document sorter according to claim 15 further comprising:

a first photo detector positioned at the entry of said first document guide; and photo detectors at the exit of each deflector group.

17. The document sorter according to claim 16 further comprising first and second bin assemblies positioned to receive documents deflected along said first and second directions, respectively, each said bin assembly formed into a series of compartments, each compartment of said first bin assembly positioned to receive documents deflected in said first direction by a corresponding one of said document guides and each compartment of said second bin assembly positioned to receive documents reflected in said second direction by a corresponding one of said document guides.

18. The document sorter according to claim 17 wherein each said compartment further comprises a plate having projections to facilitate the sliding of documents entering said compartment and the correct positioning of said documents in said compartment, each said bin assembly having a movable wall to modifying the length of said compartments to receive documents of different lengths.

* * * * *

UNITED STATES PATENT AND TRADEMARK OFFICE

CERTIFICATE OF CORRECTION

PATENT NO. : 4,927,031

DATED : May 22, 1990

INVENTOR(S) : Emilio B. Martin

It is certified that error appears in the above-identified patent and that said Letters Patent is hereby corrected as shown below:

| | |
|---|---|
| column 2, line 32 | delete "curved of"<br>insert--curved side of-- |
| column 4, line 33 | delete "shaft"<br>insert--shafts-- |
| column 4, line 37-38 | delete "Preferable"<br>insert--Preferably-- |
| column 5, line 57 | delete "said"<br>insert--side-- |
| column 9, line 49 | delete "said least"<br>insert-said at least-- |
| column 10, line 39 | delete "reflected"<br>insert--deflected-- |

Signed and Sealed this

First Day of October, 1991

*Attest:*

*Attesting Officer*

HARRY F. MANBECK, JR.

*Commissioner of Patents and Trademarks*